US007863823B2

(12) United States Patent
Lim

(10) Patent No.: US 7,863,823 B2
(45) Date of Patent: Jan. 4, 2011

(54) METHOD OF IMPROVING UNIFORMITY OF BRIGHTNESS BETWEEN PIXELS IN ELECTRON EMISSION PANEL

(75) Inventor: Ji-Hong Lim, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 903 days.

(21) Appl. No.: 11/385,732

(22) Filed: Mar. 22, 2006

(65) Prior Publication Data

US 2006/0220576 A1 Oct. 5, 2006

(30) Foreign Application Priority Data

Mar. 29, 2005 (KR) ..... 10-2005-0025988

(51) Int. Cl.
*G09G 3/10* (2006.01)

(52) U.S. Cl. ..... 315/169.1; 345/75.2

(58) Field of Classification Search ..... 315/169.1; 345/74.1–75.2; 313/495–497; 348/796
See application file for complete search history.

(56) References Cited

U.S. PATENT DOCUMENTS 5,262,698 A * 11/1993 Dunham ..... 315/169.1
6,603,450 B1 * 8/2003 Yamazaki et al. ..... 345/75.2
2004/0174323 A1 * 9/2004 Yamashita et al. ..... 345/75.2

* cited by examiner

*Primary Examiner*—Chanh Nguyen
*Assistant Examiner*—Ram A Mistry
(74) *Attorney, Agent, or Firm*—Christie, Parker & Hale, LLP

(57) ABSTRACT

A method of improving uniformity of brightness between pixels in an electron emission panel includes respectively applying a scan driving voltage and a data driving voltage to a scan electrode and a data electrode of each of a plurality of pixels, wherein one of the scan driving voltage and the data driving voltage is higher than the other; measuring a brightness of each of the pixels; and respectively applying a scan adjustment voltage and a data adjustment voltage to the scan electrode and the data electrode of each of the pixels based on the measured brightness of a respective one of the pixels, wherein a higher one of the scan adjustment voltage and the data adjustment voltage is applied to a same one of the scan electrode and the data electrode to which a lower one of the scan driving voltage and the data driving voltage is applied.

9 Claims, 8 Drawing Sheets

METHOD OF IMPROVING UNIFORMITY OF BRIGHTNESS BETWEEN PIXELS IN ELECTRON EMISSION PANEL

CROSS-REFERENCE TO RELATED APPLICATIONS

This application claims the benefit of Korean Patent Application No. 2005-25988 filed on Mar. 29, 2005, in the Korean Intellectual Property Office, the disclosure of which is incorporated herein by reference in its entirety.

BACKGROUND OF THE INVENTION

1. Field of the Invention

An aspect of the present invention relates to an electron emission device, and more particularly, to a method of improving uniformity of brightness between pixels in an electron emission panel.

2. Description of the Related Art

In general, electron emission devices use hot cathodes or cold cathodes as electron emission sources.

Electron emission devices using cold cathodes as electron emission sources include a Field Emitter Array (FEA) type, a Surface Conduction Emitter (SCE) type, a Metal-Insulator-Metal (MIM) type, a Metal-Insulator-Semiconductor (MIS) type, and a Ballistic electron Surface Emitting (BSE) type.

The FEA type electron emission device uses a phenomenon in which electrons are easily emitted in a vacuum in the presence of an electric field by electron emission sources made of a material having a low work function or a high β function. Examples of FEA type electron emission devices that have been developed include an FEA type electron emission device manufactured as a sharp tip structure containing molybdenum (Mo), silicon (Si), etc., as a main ingredient, and an FEA type electron emission device manufactured using a carbon material such as graphite or Diamond-Like Carbon (DLC), or a nanomaterial such as a nanotube or a nanowire.

The SCE type electron emission device has electron emitters formed by a narrow slit in a conductive thin film between a first electrode and a second electrode opposing each other on a substrate. The SCE type electron emission device uses a phenomenon in which electrons are emitted from the narrow slits forming the electron emitters when a voltage is applied across the first and second electrodes to cause a current to flow over the surface of the conductive thin film.

In the MIM type electron emission device, electron emitters have a metal-insulator-metal (MIM) structure and electrons are accelerated and emitted while moving from a metal layer having a high voltage through an insulator layer to another metal having a low voltage when a voltage is applied between the two metal layers sandwiching the insulator.

Likewise, in the MIS type electron emission device, electron emitters have a metal-insulator-semiconductor (MIS) structure and electrons are accelerated and emitted while moving from a semiconductor layer having a high voltage through an insulator layer to a metal layer having a low voltage when a voltage is applied between the metal layer and the semiconductor layer sandwiching the insulator layer.

The BSE type electron emission device uses a phenomenon in which electrons travel without being scattered when the size of a semiconductor is reduced smaller than a mean free path of electrons. In the BSE type electron emission device, an electron supplying layer formed of a metal or a semiconductor is formed on an ohmic electrode, and an insulation layer and a metal thin film are formed on the electron supplying layer. Electrons are emitted when a voltage is supplied to the ohmic electrode and the metal thin film.

An electron emission panel formed of one of the above-described electron emission devices includes a plurality of scan electrodes extending in a first direction and a plurality of data electrodes extending in a second direction and intersecting the scan electrodes, wherein pixels are defined at intersections of the scan electrodes and the data electrodes. Each pixel emits visible light, and brightness of the pixel depends on a driving signal applied to the pixel.

Ideally, when the same driving signal is applied to different pixels of the electron emission panel, the different pixels should emit visible light having the same brightness. However, in actuality, due to the characteristics of electron emission sources of the electron emission panel and problems in a manufacturing process of the electron emission panel, visible light having different brightnesses may be emitted when the same driving signal is applied to different pixels, resulting in non-uniformity of brightness between pixels.

To solve this problem, a method of compensating for brightness differences between pixels using compensation signals generated by a compensation circuit has been proposed. However, this method has a high manufacturing cost due to the separate compensation circuit, is difficult to actually implement, and causes variations in pixel life span within an electron emission panel because different compensation signals are applied to different pixels.

SUMMARY OF THE INVENTION

An aspect of the present invention provides a method of improving uniformity of brightness between pixels in an electrode emission panel to be used when the electron emission panel is manufactured.

According to an aspect of the present invention, there is provided a method of improving uniformity of brightness between a plurality of pixels in an electron emission panel including a plurality of scan electrodes extending in a first direction and a plurality of data electrodes extending in a second direction and intersecting the scan electrodes, wherein the plurality of pixels are defined at intersections of the scan electrodes and the data electrodes, the method including respectively applying a scan driving voltage and a data driving voltage to a scan electrode and a data electrode of each of the pixels, wherein one of the scan driving voltage and the data driving voltage is higher than the other; measuring a brightness of each of the pixels; and respectively applying a scan adjustment voltage and a data adjustment voltage to the scan electrode and the data electrode of each of the pixels, wherein one of the scan adjustment voltage and the data adjustment voltage is higher than the other, wherein the scan adjustment voltage and the data adjustment voltage for each of the pixels correspond to the measured brightness of a respective one of the pixels, and wherein a higher one of the scan adjustment voltage and the data adjustment voltage is applied to a same one of the scan electrode and the data electrode to which a lower one of the scan driving voltage and the data driving voltage is applied.

After the measuring of the brightness of each of the pixels, the method may further include calculating a target brightness from the measured brightness of each of the pixels; and calculating a voltage difference between the scan adjustment voltage and the data adjustment voltage for each of the pixels from the target brightness and the measured brightness of a respective one of the pixels.

The applying of the scan adjustment voltage and the data adjustment voltage to the scan electrode and the data electrode of each of the pixels may comprise setting the scan adjustment voltage and the data adjustment voltage to provide the voltage difference between the scan adjustment voltage and the data adjustment voltage calculated for a respective one of the pixels.

The greater a difference between the target brightness and the measured brightness of each of the pixels is, the greater the voltage difference between the scan adjustment voltage and the data adjustment voltage for a respective one of the pixels may be calculated to be, and the smaller the difference between the target brightness and the measured brightness of each of the pixels is, the smaller the voltage difference between the scan adjustment voltage and the data adjustment voltage for a respective one of the pixels may be calculated to be.

The electron emission panel may further include a first substrate and a second substrate separated from each other; an anode electrode disposed on a surface of the first substrate facing the second substrate; at least one phosphor disposed on a surface of the anode electrode facing the second substrate; a plurality of gate electrodes disposed on the second substrate facing the first substrate and extending in a first direction; a plurality of cathode electrodes, electrically isolated from the gate electrodes, disposed on the second substrate facing the first substrate, extending in a second direction, and intersecting the gate electrodes; and a plurality of electron emission sources electrically connected to the cathode electrodes; wherein the gate electrodes are the scan electrodes and the cathode electrodes are the data electrodes, or the gate electrodes are the cathode electrodes and the scan electrodes are the data electrodes.

The electron emission sources may be formed of a carbon material.

If the gate electrodes are the scan electrodes and the cathode electrodes are the data electrodes, the scan driving voltage may be higher than the data driving voltage and the scan adjustment voltage may be lower than the data adjustment voltage.

If the gate electrodes are the data electrodes and the cathode electrodes are the scan electrodes, the data driving voltage may be higher than the scan driving voltage and the data adjustment voltage may be lower than the scan adjustment voltage.

According to another aspect of the present invention, there is provided a method of improving uniformity of brightness between pixels in an electron emission panel including a plurality of pixels each including a first electrode and a second electrode, the method including applying a first driving voltage to the first electrode of each of the pixels and a second driving voltage lower than the first driving voltage to the second electrode of each of the pixels to cause the pixels to emit light; measuring a brightness of each of the pixels; determining a first adjustment voltage and a second adjustment voltage higher than the first adjustment voltage for each of the pixels based on the measured brightness of a respective one of the pixels; and applying the first adjustment voltage to the first electrode and the second adjustment voltage to the second electrode.

According to another aspect of the present invention, there is provided a method of improving uniformity of brightness between pixels in an electron emission panel including a plurality of pixels each including two electrodes, the method including respectively applying two predetermined driving voltages to the two electrodes of each of the pixels to cause the pixels to emit light; measuring a brightness each of the pixels; determining a target brightness based on the measured brightnesses of the pixels; and respectively applying two adjustment voltages to the two electrodes of each of the pixels to cause a brightness characteristic of each of the pixels to change so that the pixels will emit light having a brightness closer to the target brightness a next time the two predetermined driving voltages are respectively applied to the two electrodes of each of the pixels.

According to another aspect of the present invention, an electron emission panel includes a plurality of pixels each including a first electrode and a second electrode, the pixels having respective brightness characteristics that have been adjusted to improve uniformity of brightness between the pixels by applying a first driving voltage to the first electrode of each of the pixels and a second driving voltage lower than the first driving voltage to the second electrode of each of the pixels to cause the pixels to emit light; measuring a brightness of each of the pixels; determining a first adjustment voltage and a second adjustment voltage higher than the first adjustment voltage for each of the pixels based on the measured brightness of a respective one of the pixels; and applying the first adjustment voltage to the first electrode and the second adjustment voltage to the second electrode.

Additional aspects and/or advantages of the invention will be set forth in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
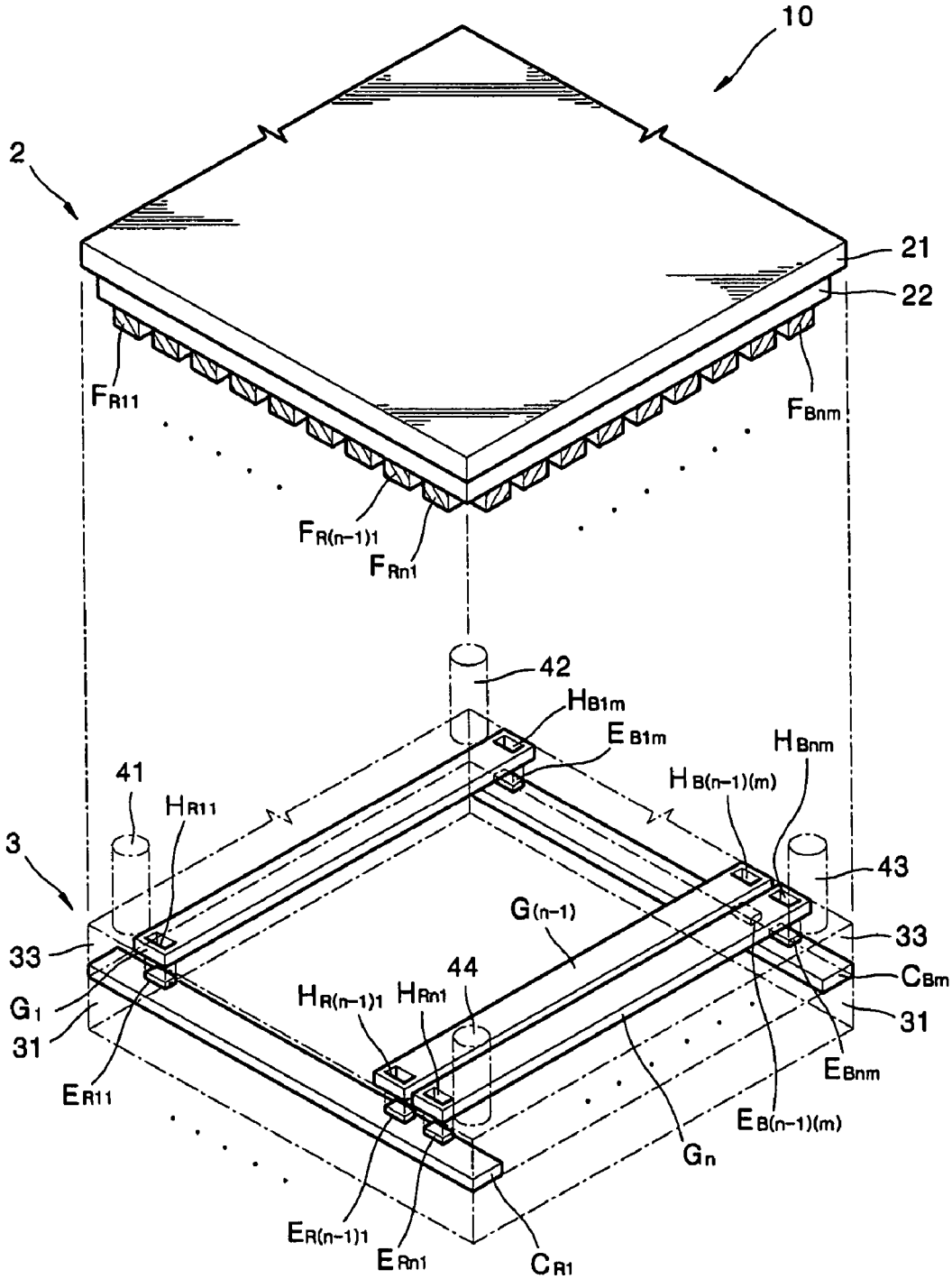
FIG. 1 is a perspective view of an exemplary electron emission panel to which a method of improving uniformity of brightness between pixels in an electron emission panel according to an embodiment of the present invention is applied.

Reference will now be made in detail to the present embodiments of the present invention, examples of which are shown in the accompanying drawings, wherein like reference numerals refer to the like elements throughout. The embodiments are described below to explain the present invention by referring to the figures.

FIG. 1 is a perspective view of an electron emission panel 10 to which a method of improving uniformity of brightness between pixels in an electron emission panel according to an embodiment of the present invention is applied.

Referring to FIG. 1, the electron emission panel 10 includes a first panel 2 and a second panel 3 separated from each other by spacers 41 through 44 for supporting the first panel 2 and the second panel 3.

The first panel 2 includes a first substrate 21 which is transparent, an anode electrode 22, and phosphor cells $F_{R11}$-$F_{Bnm}$.

The anode electrode 22 is disposed on a surface of the first substrate 21 facing a second substrate 31, and the phosphor cells $F_{R11}$-$F_{Bnm}$ are disposed on a surface of the anode electrode 22 facing the second substrate 31. The phosphor cells $F_{R11}$-$F_{Bnm}$ include red (R) phosphor cells including a red (R) phosphor material, green (G) phosphor cells including a green (G) phosphor material, and blue (B) phosphor cells including a blue (B) phosphor material.

The second panel 3 includes the second substrate 31, electron emission sources $E_{R11}$-$E_{Bnm}$, an insulation layer 33, cathode electrodes $C_{R1}$-$C_{Bm}$, and gate electrodes $G_1$-$G_n$ intersecting the cathode electrodes $C_{R1}$-$C_{Bm}$.

The cathode electrodes $C_{R1}$-$C_{Bm}$ are electrically connected to the electron emission sources $E_{R11}$-$E_{Bnm}$. Through holes $H_{R11}$-$H_{Bnm}$ are formed in the insulation layer 33 and the gate electrodes $G_1$-$G_n$ corresponding to the electron emission sources $E_{R11}$-$E_{Bnm}$.

When driving voltages are applied to the cathode electrodes $C_{R1}$-$C_{Bm}$ and the gate electrodes $G_1$-$G_n$ (generally, the driving voltage applied to the cathode electrodes $C_{R1}$-$C_{Bm}$ is lower than the driving voltage applied to the gate electrodes $G_1$-$G_n$), electrons are emitted from the electron emission sources $E_{R11}$-$E_{Bnm}$ if a voltage difference between the driving voltages exceeds an electron emission start voltage. At this time, if a high positive voltage between 1 kV and 4 kV is applied to the anode electrode 22, the electrons emitted from the electron emission sources $E_{R11}$-$E_{Bnm}$ are accelerated and converged onto the phosphor cells $F_{R11}$-$F_{Bnm}$ and collide with the red (R), green (G), and blue (B) phosphor materials of the phosphor cells $F_{R11}$-$F_{Bnm}$, thereby generating visible light.

Figure 2:
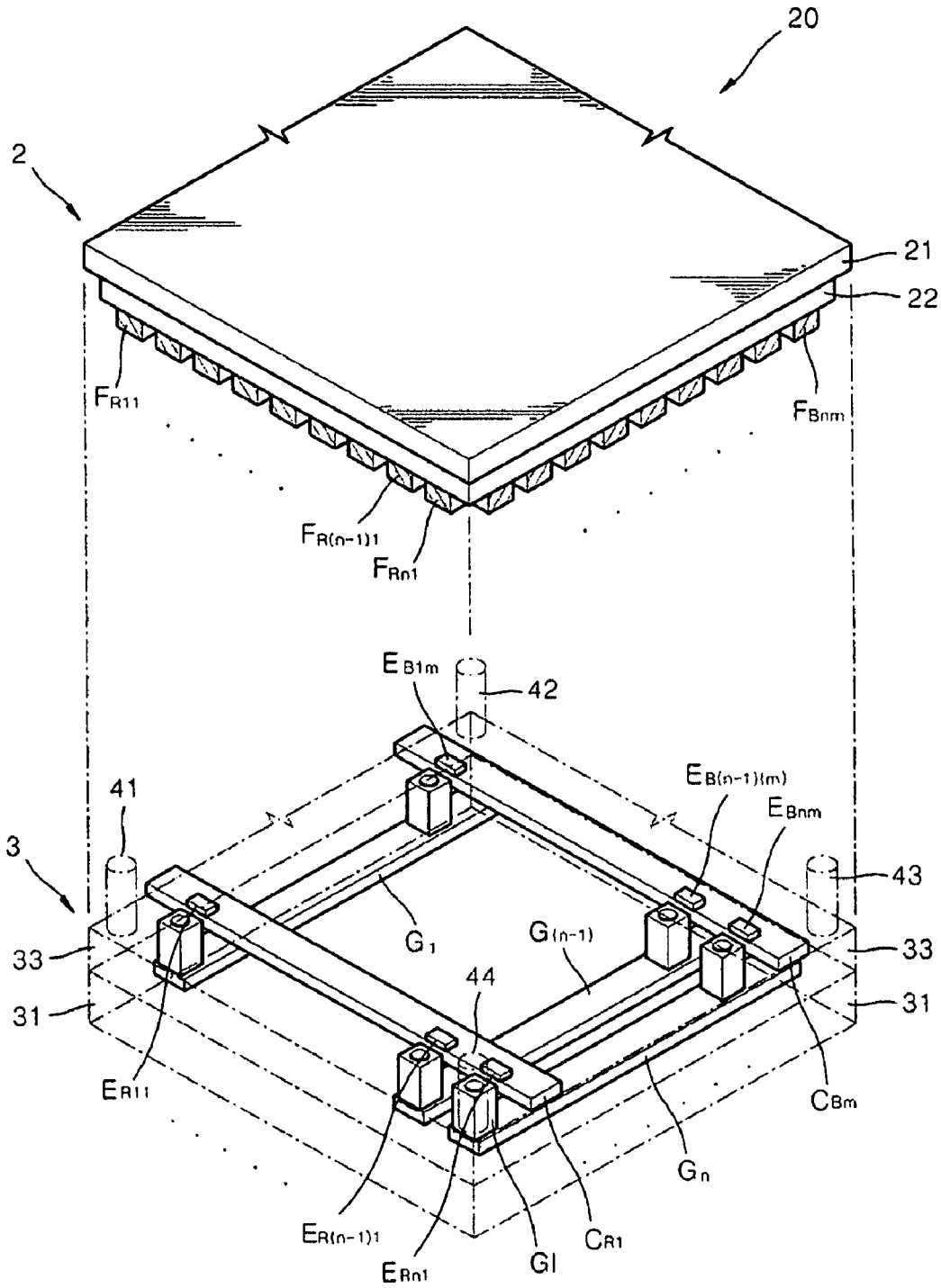
FIG. 2 is a perspective view of another exemplary electron emission panel to which a method of improving uniformity of brightness between pixels in an electron emission panel according to an embodiment of the present invention is applied.

FIG. 2 is a perspective view of another electron emission panel 20 to which a method of improving uniformity of brightness between pixels in electron emission panel according to an embodiment of the present invention is applied.

Referring to FIGS. 1 and 2, the electron emission panel 20 shown in FIG. 2 is different from the electron emission panel 10 shown in FIG. 1 with respect to an arrangement of the cathode electrodes $C_{R1}$-$C_{Bm}$ and the gate electrodes $G_1$-$G_n$.

The electron emission panel 20 shown in FIG. 2 includes a first panel 2 and a second panel 3 separated from each other by spacers 41 through 44 for supporting the first panel 2 and the second panel 3.

The first panel 2 includes a first substrate 21 which is transparent, an anode electrode 22, and phosphor cells $F_{R11}$-$F_{Bnm}$.

The anode electrode 22 is disposed on a surface of the first substrate 21 facing a second substrate 31, and the phosphor cells $F_{R11}$-$F_{Bnm}$ are disposed on a surface of the anode electrode 22 facing the second substrate 31. The phosphor cells $F_{R11}$-$F_{Bnm}$ include red (R) phosphor cells including a red (R) phosphor material, green (G) phosphor cells including a green (G) phosphor material, and blue (B) phosphor cells including a blue (B) phosphor material.

The second panel 3 includes the second substrate 31, electron emission sources $E_{R11}$-$E_{Bnm}$, an insulation layer 33, cathode electrodes $C_{R1}$-$C_{Bm}$, and gate electrodes $G_1$-$G_n$ intersecting the cathode electrodes $C_{R1}$-$C_{Bm}$.

The cathode electrodes $C_{R1}$-$C_{Bm}$ are electrically connected to the electron emission sources $E_{R11}$-$E_{Bnm}$. Gate islands GI are formed on the gate electrodes $G_1$-$G_n$ and extend toward the first substrate 21 so as to pass through the insulation layer 33 and extend to positions adjacent to sides of the electron emission sources $E_{R11}$-$E_{Bnm}$.

In the electron emission panel 20 having the structure shown in FIG. 2 where the gate electrodes $G_1$-$G_n$ are positioned lower than the cathode electrodes $C_{R1}$-$C_{Bm}$ relative to the first substrate 21, electrons emitted from the cathode electrodes $C_{R1}$-$C_{Bm}$ drift toward the gate islands GI due to a voltage difference between the cathode electrodes $C_{R1}$-$C_{Bm}$ and the gate islands GI connected to the gate electrodes $G_1$-$G_n$. At this time, if a high positive voltage between 1 kV and 4 kV is applied to the anode electrode 22, the electrons emitted from the electron emission sources $E_{R11}$-$E_{Bnm}$ are accelerated and converged onto the phosphor cells $F_{R11}$-$F_{Bnm}$ and collide with the red (R), green (G), and blue (B) phosphor materials of the phosphor cells $F_{R11}$-$F_{Bnm}$, thereby generating visible light.

Figure 3:
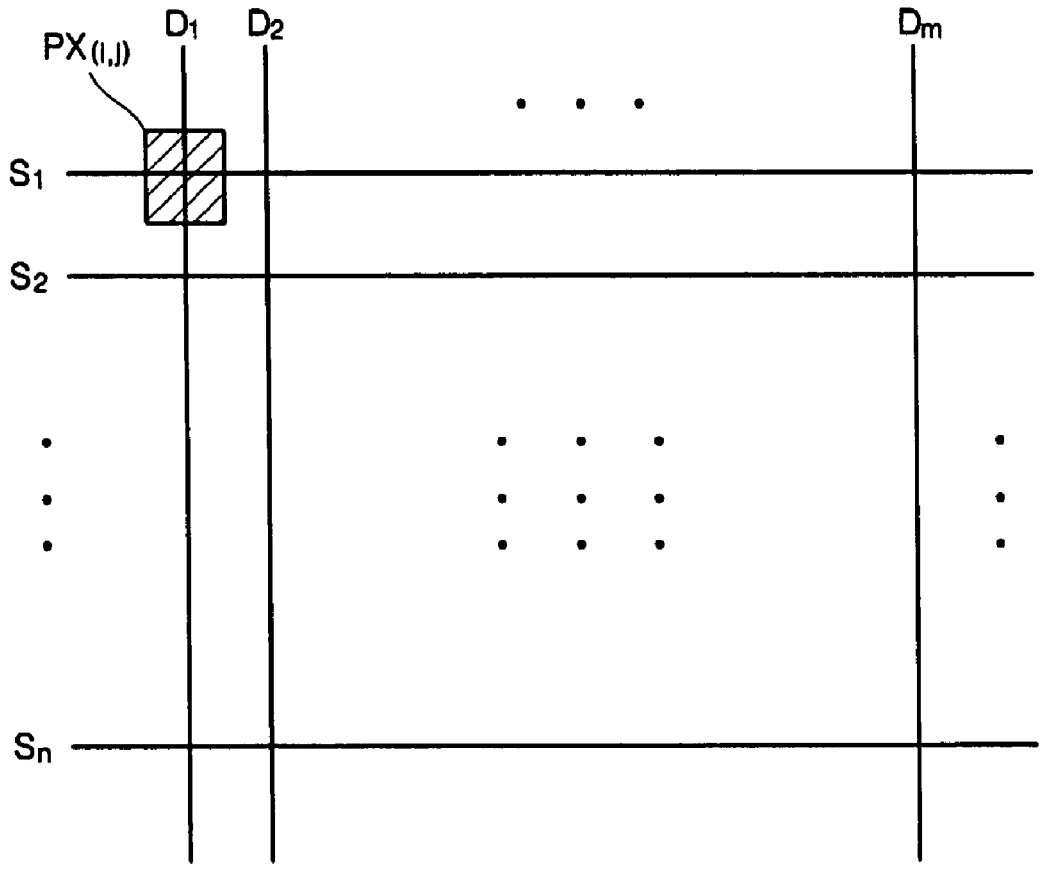
FIG. 3 shows an arrangement of scan electrodes and data electrodes in the electrode emission panels shown in FIGS. 1 and 2 to which driving signals according to an embodiment of the present invention are applied.

FIG. 3 shows an arrangement of electrodes in the electrode emission panels 10 and 20 shown in FIGS. 1 and 2 to which driving signals according to an embodiment of the present invention are applied.

The cathode electrodes $C_{R1}$-$C_{Bm}$ shown in FIG. 1 or 2 may be used as the data electrodes $D_1$-$D_m$ shown in FIG. 3, and the gate electrodes $G_1$-$G_n$ shown in FIG. 1 or 2 may be used as the scan electrodes $S_1$-$S_n$ shown in FIG. 3, and vice versa.

The scan electrodes $S_1$-$S_n$ extend in a first direction and the data electrodes $D_1$-$D_m$ extend in a second direction and intersect the scan electrodes $S_1$-$S_n$. Pixels $PX_{(i,j)}$ are defined at intersections of the scan electrodes $S_1$-$S_n$ and the data electrodes $D_1$-$D_m$. Each pixel $PX_{(i,j)}$ is a basic unit for displaying an image. If red (R), green (G), and blue (B) phosphor cells including red (R), green (G), and blue (B) phosphors for emitting red (R), green (G), and blue (B) light are sequentially arranged along the scan electrodes $S_1$-$S_n$ at the intersections with the data electrodes $D_1$-$D_m$, visible light made up of red (R), green (G), and blue (B) components is generated in an area encompassing the intersections of three data electrodes and one scan electrode, and accordingly the intersections of the three data electrodes and the one scan electrode may be defined to be a pixel. In this case, an intersection of a single data electrode and one scan electrode may be defined to be a sub pixel.

Figure 4:
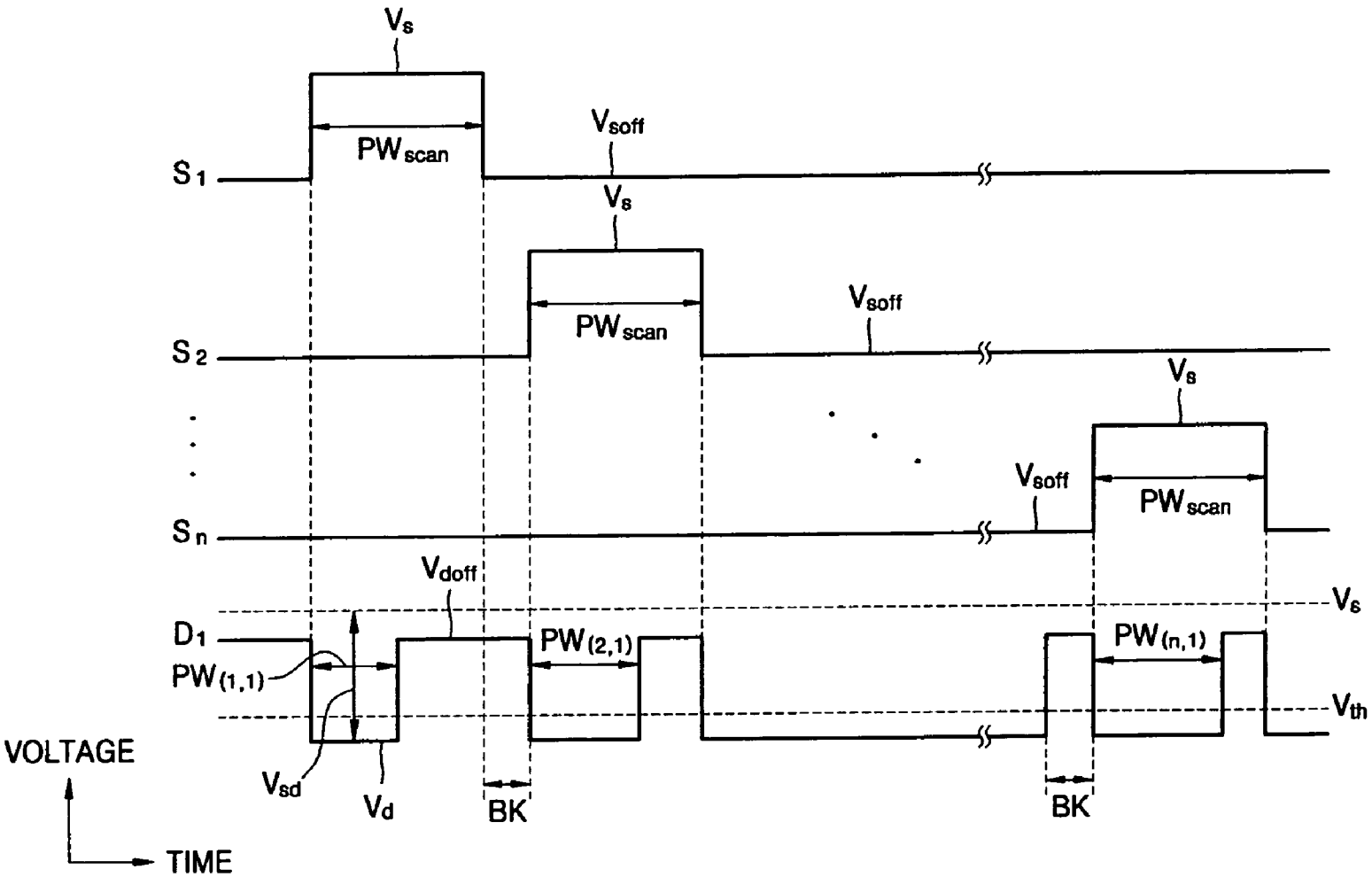
FIG. 4 shows timing diagrams of driving signals applied to the scan electrodes and the data electrodes shown in FIG. 3.

FIG. 4 shows timing diagrams of driving signals applied to the scan electrodes $S_1$-$S_n$ and the data electrodes $D_1$-$D_m$ shown in FIG. 3.

FIG. 4 shows a case in which a PWM method is used for gray-scale display.

Referring to FIGS. 3 and 4, scan driving signals are sequentially applied to the scan electrodes $S_1$-$S_n$ and data driving signals are applied to the data electrodes $D_1$-$D_m$ in synchronization with the scan driving signals. Data driving signals are simultaneously applied to all of the data electrodes $D_1$-$D_m$ each time a scan driving signal is applied to one of the scan electrodes $S_1$-$S_n$.

Each scan driving signal has a scan driving voltage $V_s$ which is logic high and a scan off voltage $V_{soff}$ which is logic low. While a scan electrode is being scanned, a scan driving voltage $V_s$ having a predetermined scan pulse width $PW_{scan}$ is applied to the scan electrode.

Each data driving signal has a data off voltage $V_{doff}$ which is logic high and a data driving voltage $V_d$ which is logic low. A voltage difference $V_{sd}$ between the scan driving voltage $V_s$ and the data driving voltage $V_d$ is higher than an electron emission start voltage $V_{th}$ at which electrons begin to be emitted from the electron emission sources $E_{R11}$-$E_{Bnm}$. The logic levels of the scan driving signals and the data driving signals shown in FIG. 4 may be reversed, so that the scan driving voltage $V_s$ may be logic low and the data driving voltage $V_d$ may be logic high, which is the opposite of what is shown in FIG. 4. The data pulse width of the data driving signal varies for gray-scale display. In FIG. 4, a data driving signal applied to a first data electrode $D_1$ is shown. The brightnesses of pixels $PX_{(1,1)}$, $PX_{(2,1)}$, . . . , $PX_{(n,1)}$ respectively depend on data pulse widths $PW_{(1,1)}$, $PW_{(2,1)}$, . . . , $PW_{(n,1)}$.

As the scan driving voltages $V_s$ are applied to the corresponding scan electrodes, blanking periods BK for preventing crosstalk between pixels are provided between the ending time of one scan signal and the beginning time of a succeeding scan signal.

Figure 5:
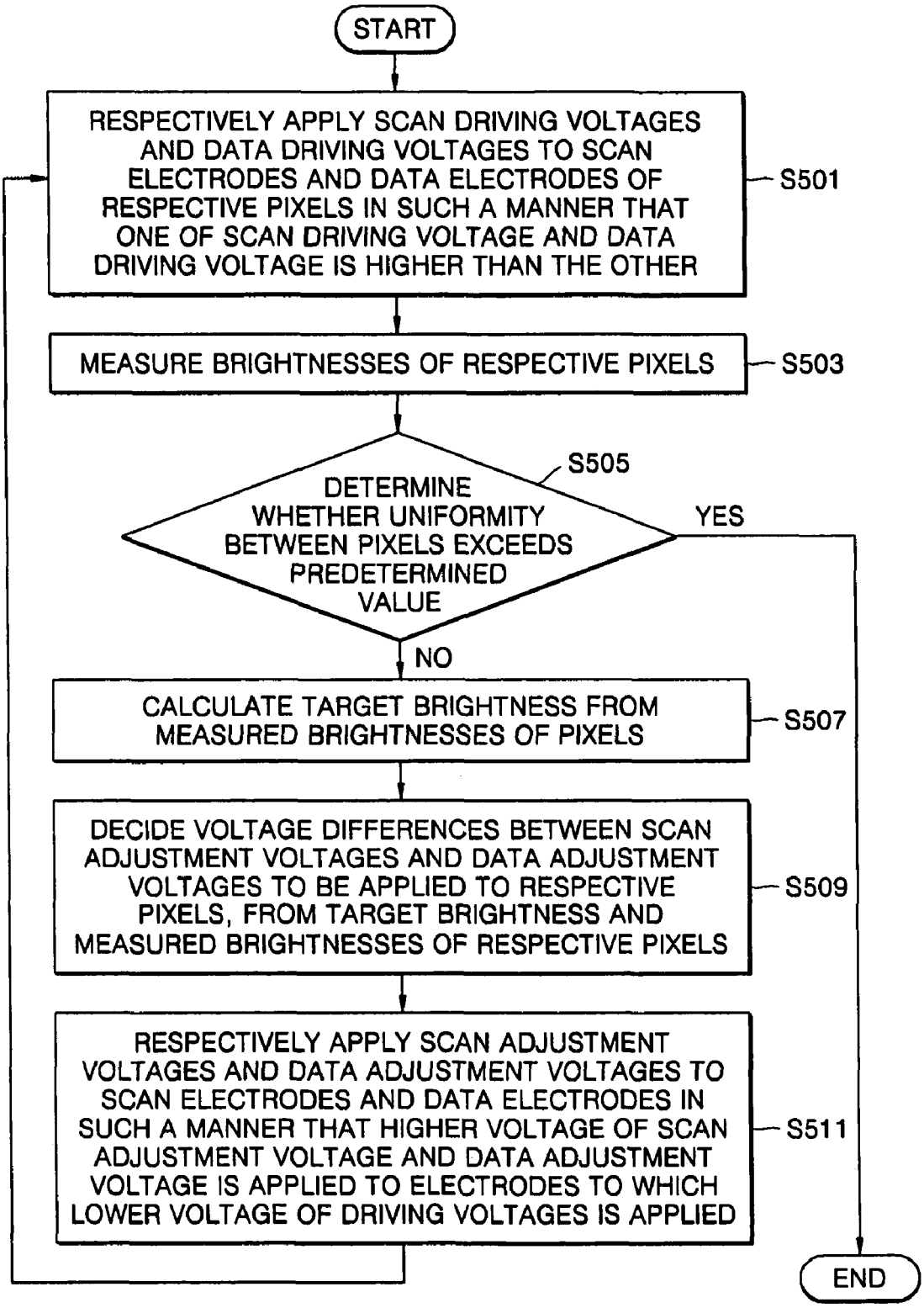
FIG. 5 is a flowchart showing a method of improving uniformity of brightness between pixels in an electron emission panel according to an embodiment of the present invention.
Figure 6:
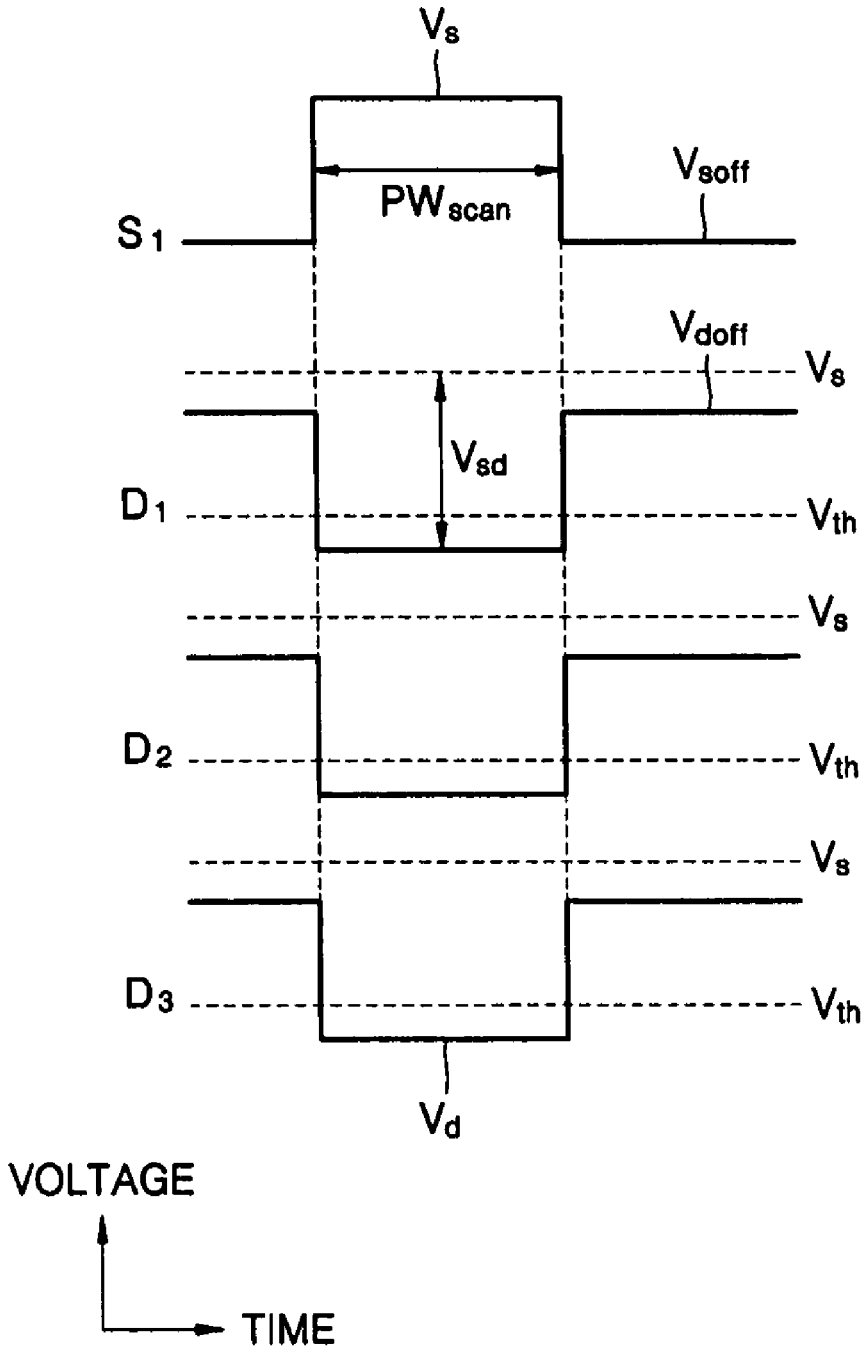
FIG. 6 shows timing diagrams of a scan driving signal and data driving signals applied to the scan electrodes and the data electrodes shown in FIG. 3 to perform operation S501 shown in FIG. 5.
Figure 7:
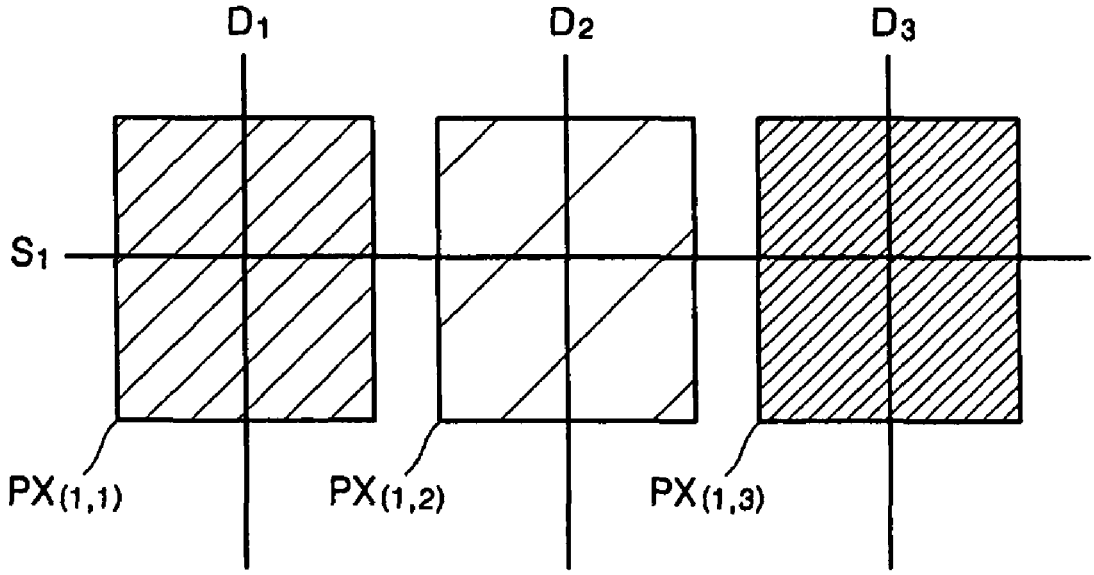
FIG. 7 is a view showing brightness differences between pixels appearing when the scan driving signal and the data driving signals shown in FIG. 6 are applied to the scan electrode and the data electrodes of the pixels shown in FIG. 7.
Figure 8:
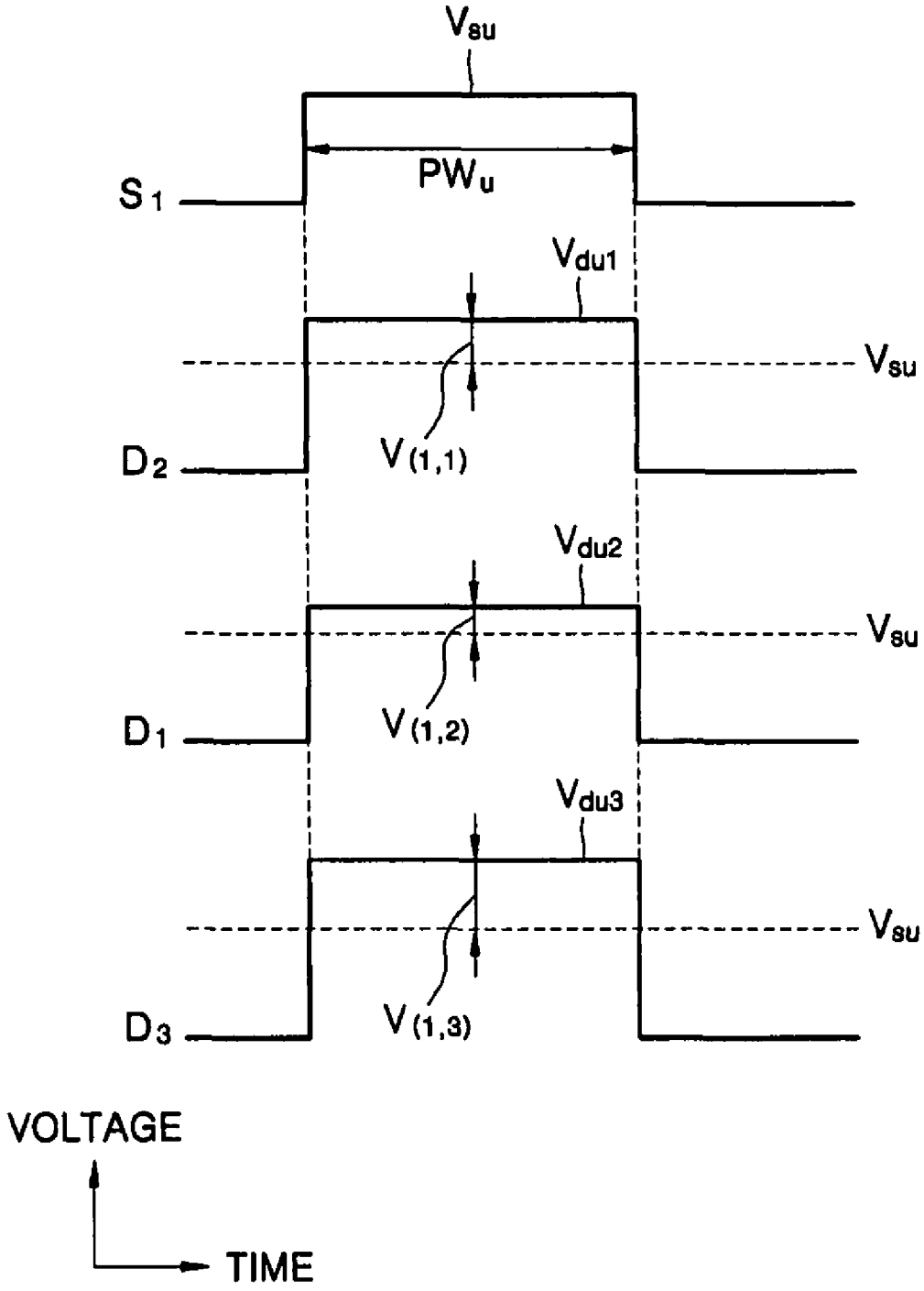
FIG. 8 shows timing diagrams of uniformity adjustment signals applied to the scan electrodes and the data electrodes of the pixels shown in FIG. 7 to compensate for the brightness differences between the pixels.

FIG. 5 is a flowchart showing a method of improving uniformity of brightness between pixels in an electron emission panel according to an embodiment of the present invention. FIG. 6 shows timing diagrams of a scan driving signal and data driving signals applied to the scan electrodes and the data electrodes shown in FIG. 3 to perform operation S501 shown in FIG. 5. FIG. 7 is a view brightness differences between pixels appearing when the scan driving signal and the data driving signals shown in FIG. 6 are applied to the scan electrode and the data electrodes of the pixels shown in FIG. 7. FIG. 8 shows timing diagrams of uniformity adjustment signals applied to the scan electrode and the data electrodes of the pixels shown in FIG. 7 to compensate for the brightness differences between the pixels.

Referring to FIGS. 5 through 8, a method of improving uniformity of brightness between pixels in an electron emission panel according to an embodiment of the present invention includes the following operations.

First, in an operation S501, a scan driving voltage and a data driving voltage are respectively applied to a scan electrode and a data electrode of each pixel in such a manner that one of the scan and data driving voltages is higher than the other.

While scan driving signals are applied to the scan electrodes of respective pixels, data driving signals having the same data pulse width are applied to the data electrodes of the respective pixels. Ideally, if the data driving signals having the same data pulse width are applied to the data electrodes of the respective pixels, the pixels will emit visible light having the same brightness. However, due to problems in a manufacturing process of the electron emission panel, the brightness of each of the respective pixels may vary. For this reason, to detect the brightness characteristics of the respective pixels, data driving signals having the same data pulse width are applied to the respective pixels. That is, by applying the same data driving voltage having the same data pulse width to the respective pixels, the brightness characteristics of the respective pixels can be detected.

FIG. 6 shows an example where a scan driving signal having a predetermined scan pulse width $PW_{scan}$ is applied to a first scan electrode $S_1$ and data driving signals are applied to first, second, and third data electrodes $D_1$, $D_2$, and $D_3$ in operation S501. The scan driving signal has a scan driving voltage $V_s$ which is logic high to scan the first scan electrode, and a scan off voltage $V_{soff}$ which is logic low. While the scan driving voltage $V_s$ is applied to the first scan electrode $S_1$, the data driving signals having the same data pulse width are applied to the first, second, and third data electrodes $D_1$, $D_2$, and $D_3$. In FIG. 6, the data pulse width is equal to the scan pulse width $PW_{scan}$, but the present invention is not limited to this. Each data driving signal has a data off voltage $V_{doff}$ which is logic high and a data driving voltage $V_d$ which is logic low. In FIG. 6, the scan driving voltage $V_s$ of the scan driving signal is higher than the data driving voltage $V_d$ of the data driving signal. However, the data driving voltage $V_d$ may be higher than the scan driving voltage $V_s$ so that the data driving voltage $V_d$ is logic high and the scan driving voltage $V_s$ is logic low. A voltage difference $V_{sd}$ between the data driving voltage $V_d$ and the scan driving voltage $V_s$ is necessarily higher than an electron emission start voltage $V_{th}$. In FIG. 6, since the scan driving voltage $V_s$ is higher than the data driving voltage $V_d$, the gate electrodes $G_1$-$G_n$ of the electron emission panel 10 or 20 shown in FIG. 1 or 2 are used as the scan electrodes $S_1$-$S_n$ shown in FIG. 3, and the cathode electrodes $C_{R1}$-$C_{Bm}$ of the electron emission panel 10 or 20 shown in FIG. 2 are used as the data electrodes $D_1$-$D_m$ shown in FIG. 3.

Then, in operation S503, the brightnesses of the respective pixels are measured. By applying the scan driving signals and the data driving signals having the same data pulse width to the respective pixels, the respective pixels emit visible light having brightnesses that depend on the brightness characteristics of the pixels. FIG. 7 is a view showing the brightness differences of visible light emitted from the respective pixels when the driving signals shown in FIG. 6 are applied. Referring to FIG. 7, the brightness of a pixel $PX_{(1,3)}$ is highest, the brightness of a pixel $PX_{(1,1)}$ is next highest, and the brightness of a pixel $PX_{(1,2)}$ is lowest.

Returning to FIG. 5, in operation S505, it is determined whether uniformity of brightness between the pixels exceeds a predetermined value. If the uniformity of brightness between the pixels exceeds the predetermined value, it is determined that the uniformity of brightness between the pixels is sufficient and the process is terminated. If the uniformity of brightness between the pixels is smaller than the predetermined value, the operations described below are performed. Here, the uniformity of brightness between the pixels is defined as a percentage of minimum brightness with respect to maximum brightness, but the present invention is not limited to this. For example, if the maximum brightness is equal to the minimum brightness, the uniformity of brightness between the pixels is 100%. The predetermined value may be defined as 90%, but the present invention is not limited to this value. Accordingly, if the uniformity of brightness between the pixels is smaller than 90%, the operations described below are performed.

If the uniformity of brightness between the pixels is smaller than the predetermined value, in operation S507, a target brightness is calculated from the measured brightnesses of the pixels. Here, the target brightness may be a minimum brightness of the measured brightnesses of the pixels, but the present invention is not limited to this.

Then, in operation S509, voltage differences between scan adjustment voltages and data adjustment voltages to be applied to the respective pixels are calculated from the calculated target brightness and the measured brightness of each of the respective pixels.

To improve the uniformity of brightness between the pixels, the greater a difference between the target brightness and the measured brightness of a pixel, the greater a voltage difference between a scan adjustment voltage and a data adjustment voltage to be applied to the pixel is set. Likewise, the smaller a difference between the target brightness and the measured brightness of a pixel, the smaller a voltage difference between a scan adjustment voltage and a data adjustment voltage to be applied to the pixel is set. That is, a voltage difference between a scan adjustment voltage and a data adjustment voltage to be applied to a pixel is set in proportion to a difference between the target brightness and the measured brightness of the pixel.

Then, in operation S511, scan adjustment voltages and data adjustment voltages are respectively applied to the scan electrodes and the data electrodes in such a manner that the higher adjustment voltages are applied to electrodes to which the lower voltages of the driving voltages applied in operation S501 are applied.

To adjust the brightness characteristics of the respective pixels, the scan adjustment voltages and the data adjustment voltages are respectively applied to the scan electrodes and the data electrodes of the respective pixels so that the voltage differences obtained in operation S509 are maintained. Referring to FIG. 6 which shows driving signals for performing operation S501, the scan driving voltage $V_s$ of the scan driving signal is higher than the data driving voltage $V_d$ of the data driving signal. Accordingly, in operation S511, it is preferable that the data adjustment voltages are higher than the scan adjustment voltages so that the brightness characteristics of the respective pixels may be adjusted.

FIG. 8 shows timing diagrams of examples of uniformity adjustment signals applied to a scan electrode and data electrodes to improve uniformity of brightness between the pixels shown in FIG. 7.

Referring to FIGS. 7 and 8, since the brightness of the pixel $PX_{(1,3)}$ is highest, the brightness of the pixel $PX_{(1,1)}$ is next highest, and the brightness of the pixel $PX_{(1,2)}$ is lowest, a voltage difference between a scan adjustment voltage and a data adjustment voltage is highest ($V_{(1,3)}$) at the pixel $PX_{(1,3)}$, next highest ($V_{(1,1)}$) at the pixel $PX_{(1,1)}$, and lowest ($V_{(1,2)}$) at the pixel $PX_{(1,2)}$. That is, if a scan adjustment voltage $V_{su}$ is applied to a first scan electrode $S_1$, a highest data adjustment voltage $V_{du3}$ is applied to a third data electrode $D_3$, a next highest data adjustment voltage $V_{du1}$ is applied to a first data electrode $D_1$, and a lowest data adjustment voltage $V_{du2}$ is applied to a second data electrode $D_2$.

By applying the data adjustment voltages in this manner, the brightness characteristics between the pixels, that is, the brightness characteristics of the electron emission sources, can be adjusted. Referring to FIGS. 1, 2, and 3, if the gate electrodes $G_1$-$G_n$ of the electron emission panel 10 or 20 shown in FIG. 1 or 2 are used as the scan electrodes $S_1$-$S_n$ shown in FIG. 3, and the cathode electrodes $C_{R1}$-$C_{Bm}$ of the electron emission panel 10 or 20 shown in FIG. 1 or 2 are used as the data electrodes $D_1$-$D_m$ shown in FIG. 3, data adjustment voltages applied to the electron emission sources $E_{R11}$-$E_{Bnm}$ which are electrically connected to the data electrodes $D_1$-$D_m$ are higher than scan adjustment voltages applied to the scan electrodes $S_1$-$S_n$. Accordingly, no electrons are emitted. Thereafter, if driving voltages are applied so that an electron emission start condition is satisfied and electrons are emitted, the electron emission characteristics of the electron emission sources deteriorate. That is, if a data driving voltage and a scan driving voltage higher than the data driving voltage are applied to the respective pixels while a data adjustment voltage and a scan adjustment voltage lower than the data adjustment voltage are applied to the respective pixels, the electron emission characteristics of the electron emission sources deteriorate. As the voltage difference between the data adjustment voltage and the scan adjustment voltage increases, the electron emission characteristics of the electron emission sources further deteriorate. This phenomenon is significant if the electron emission sources are formed of a carbon material, and more significant if the electron emission sources are formed of carbon nanotubes (CNTs). By utilizing this phenomenon, uniformity of brightness between all of a plurality of pixels can be improved.

To compensate for the characteristics of the electron emission sources, a pulse width $PW_u$ of uniformity adjustment signals shown in FIG. 8 is preferably wider than the scan pulse width $PW_{scan}$ of the scan driving signal shown in FIG. 6. For example, the pulse width $PW_u$ of the uniformity adjustment signal may be 1, 2, or 4 minutes.

Then, operation S501 is again performed. By repeating the operations described above, uniformity of brightness between pixels can be improved.

According to the embodiment of the present invention shown in FIGS. 5 to 8, the gate electrodes $G_1$-$G_n$ shown in FIG. 1 or 2 are used as the scan electrodes $S_1$-$S_n$ shown in FIG. 3, and the cathode electrodes $C_{R1}$-$C_{Bm}$ shown in FIG. 1 or 2 are used as the data electrodes $D_1$-$D_m$ shown in FIG. 3. However, it is also possible that the gate electrodes $G_1$-$G_n$ shown in FIG. 1 or 2 are used as the data electrodes $D_1$-$D_m$ shown in FIG. 3, and the cathode electrodes $C_{R1}$-$C_{Bm}$ shown in FIG. 1 or 2 are used as the scan electrodes $S_1$-$S_n$ shown in FIG. 3. In this case, the data driving voltage $V_d$ must be higher than the scan driving voltage $V_s$ and the scan adjustment voltage $V_{su}$ must be higher than the data adjustment voltage $V_{du}$ to improve uniformity of brightness between pixels.

The above operations are performed at the final stage of a manufacturing process of an electron emission panel.

In the embodiments according to the present invention described above, the following effects can be obtained.

By applying a voltage higher than a voltage of gate electrodes to electron emission sources electrically connected to cathode electrodes, non-uniformity of brightness between pixels due to problems in a manufacturing process of an electron emission panel can be reduced, and the color purity of visible light emitted from the pixels can be improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of improving uniformity of brightness between a plurality of pixels in an electron emission panel comprising a plurality of scan electrodes extending in a first direction and a plurality of data electrodes extending in a second direction and intersecting the scan electrodes, wherein the plurality of pixels are defined at intersections of the scan electrodes and the data electrodes, the method comprising:

respectively directly applying a scan driving voltage and a data driving voltage to a scan electrode and a data electrode of each of the pixels, wherein one of the scan driving voltage and the data driving voltage is higher than the other;

measuring a brightness of each of the pixels; and respectively directly applying a scan adjustment voltage and a data adjustment voltage to the scan electrode and the data electrode of each of the pixels;

wherein:

one of the scan adjustment voltage and the data adjustment voltage is higher than the other;

the scan adjustment voltage and the data adjustment voltage for each of the pixels correspond to the measured brightness of a respective one of the pixels;

if the scan driving voltage is higher than the data driving voltage, the scan adjustment voltage is lower than the data adjustment voltage; and if the scan driving voltage is lower than the data driving voltage, the scan adjustment voltage is higher than the data adjustment voltage.

2. The method of claim 1, further comprising, after the measuring of the brightness of each of the pixels:

calculating a target brightness from the measured brightness of each of the pixels; and calculating a voltage difference between the scan adjustment voltage and the data adjustment voltage for each of the pixels from the target brightness and the measured brightness of a respective one of the pixels.

3. The method of claim 2, wherein the directly applying of the scan adjustment voltage and the data adjustment voltage to the scan electrode and the data electrode of each of the pixels comprises setting the scan adjustment voltage and the data adjustment voltage to provide the voltage difference between the scan adjustment voltage and the data adjustment voltage calculated for a respective one of the pixels.

4. The method of claim 3, wherein the greater a difference between the target brightness and the measured brightness of each of the pixels is, the greater the voltage difference between the scan adjustment voltage and the data adjustment voltage for a respective one of the pixels is calculated to be, and the smaller the difference between the target brightness and the measured brightness of each of the pixels is, the smaller the voltage difference between the scan adjustment voltage and the data adjustment voltage for a respective one of the pixels is calculated to be.

5. The method of claim 4, wherein the electron emission panel further comprises:

a first substrate and a second substrate separated from each other;

an anode electrode disposed on a surface of the first substrate facing the second substrate;

at least one phosphor disposed on a surface of the anode electrode facing the second substrate;

a plurality of gate electrodes disposed on the second substrate facing the first substrate and extending in a first direction;

a plurality of cathode electrodes, electrically isolated from the gate electrodes, disposed on the second substrate facing the first substrate, extending in a second direction, and intersecting the gate electrodes; and a plurality of electron emission sources electrically connected to the cathode electrodes;

wherein the gate electrodes are the scan electrodes and the cathode electrodes are the data electrodes, or the gate electrodes are the data electrodes and the cathode electrodes are the scan electrodes.

6. The method of claim 5, wherein the electron emission sources are formed of a carbon material.

7. The method of claim 6, wherein if the gate electrodes are the scan electrodes and the cathode electrodes are the data electrodes, the scan driving voltage is higher than the data driving voltage and the scan adjustment voltage is lower than the data adjustment voltage.

8. The method of claim 6, wherein if the gate electrodes are the data electrodes and the cathode electrodes are the scan electrodes, the data driving voltage is higher than the scan driving voltage and the data adjustment voltage is lower than the scan adjustment voltage.

9. The method of claim 1, wherein:

each of the pixels comprises an electron emission source; and the electron emission source does not emit electrons when the first adjustment voltage is directly applied to the first electrode and the second adjustment voltage is directly applied to the second electrode.

* * * * *